US005407407A

United States Patent [19]

Lin

[11] Patent Number: 5,407,407

[45] Date of Patent: Apr. 18, 1995

[54] EASILY FOLDED AND ASSEMBLED STEPPING EXERCISER

[76] Inventor: Eric S. Lin, No. 501, Sec. 3, Chang Shui Rd., Kuang Ping Li, Hsi Hu Chen, Changhua Hsien, Prov. of China

[21] Appl. No.: 174,193

[22] Filed: Dec. 27, 1993

[51] Int. Cl.[6] ..... A63B 22/04

[52] U.S. Cl. ..... 482/53; 482/908

[58] Field of Search ..... 482/51, 52, 53, 70, 482/71, 57, 54, 908

[56] References Cited

U.S. PATENT DOCUMENTS

| | | | |
|---|---|---|---|
| 5,145,476 | 9/1992 | Chiavello | 482/53 |
| 5,178,592 | 1/1993 | Yang | 482/53 |
| 5,222,927 | 6/1993 | Chang | 482/53 |

OTHER PUBLICATIONS

"Action Stepper"-Roadmaster Corporation-Owner's manual, copyright Aug. 15, 1990.

*Primary Examiner*—Stephen R. Crow

*Attorney, Agent, or Firm*—Omri M. Behr; Matthew J. McDonald

[57] ABSTRACT

A foldable and assembly tool free stepping exerciser includes a base having a first securing member and a restraining element, a telescopic post being releasably secured to the base by the first securing member and the restraining element to hold the telescopic post vertically, a pair of support arms being pivotally linked to a first end of the base at a respective first end of the support arms and a respective second end of the support arms being pivotally linked to the post, a pair of stepping pedals being pivotally connected to the first end of the base at a first end of the pedals and a pair of hydraulic cylinders being releaseably connected to the corresponding stepping pedals at a respective first end of the hydraulic cylinders and their second ends being pivotally connected to the post; the telescopic post having a fixing component formed at its first end to cooperate with the first securing member for holding the telescopic post vertically, an inner tube being telescopically received in the post, a second securing member for retaining the inner tube in an extended position and a third securing member disposed at the distal end of the inner tube to rotatably secure a handle bar to it.

4 Claims, 5 Drawing Sheets

EASILY FOLDED AND ASSEMBLED STEPPING EXERCISER

BACKGROUND OF THE INVENTION

The present invention relates to a stepping exerciser and, more particularly, to an easily folded and assembled stepping exerciser that needs no tools for assembly.

There have been various leg exercise machines and most of them have a fixed structure. This type of exercise machine requires a large space not only in storage but also in transportation thus causing high costs. In addition, the fixed structure usually has extending components which increase the difficulty in handling as well as the possibility of being damaged in handling and that, too, increases the cost. Furthermore, such stepping exerciser requires a relative large space to place it, even when it is not in use. In a place where space is costly, the lack of compactness of this type of stepping exerciser becomes a big disadvantage both in daily storage and in use.

To overcomes the aforementioned problems, the present invention therefore provides an improved stepping exerciser which is not only more compact in storage and transportation but also more easier to set up for use.

SUMMARY OF THE INVENTION

It is an object of the present invention to provide a stepping exerciser which is retractable, foldable and assembly without the use of tools in setting up for use. Thus the stepping exerciser not only can be packed, stored and handled in a compact manner but also can be readily set up for use with little effort and no assembly tools are required.

It is a further object of the present invention to provide an easily folded and assembled stepping exerciser which includes a base, a telescopic post releasably connected to the base, a pair of support arms pivotally connected to the base and the post, a pair of stepping pedals pivotally connected to the base, a pair of hydraulic cylinders pivotally connected to the corresponding pedals and the post.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
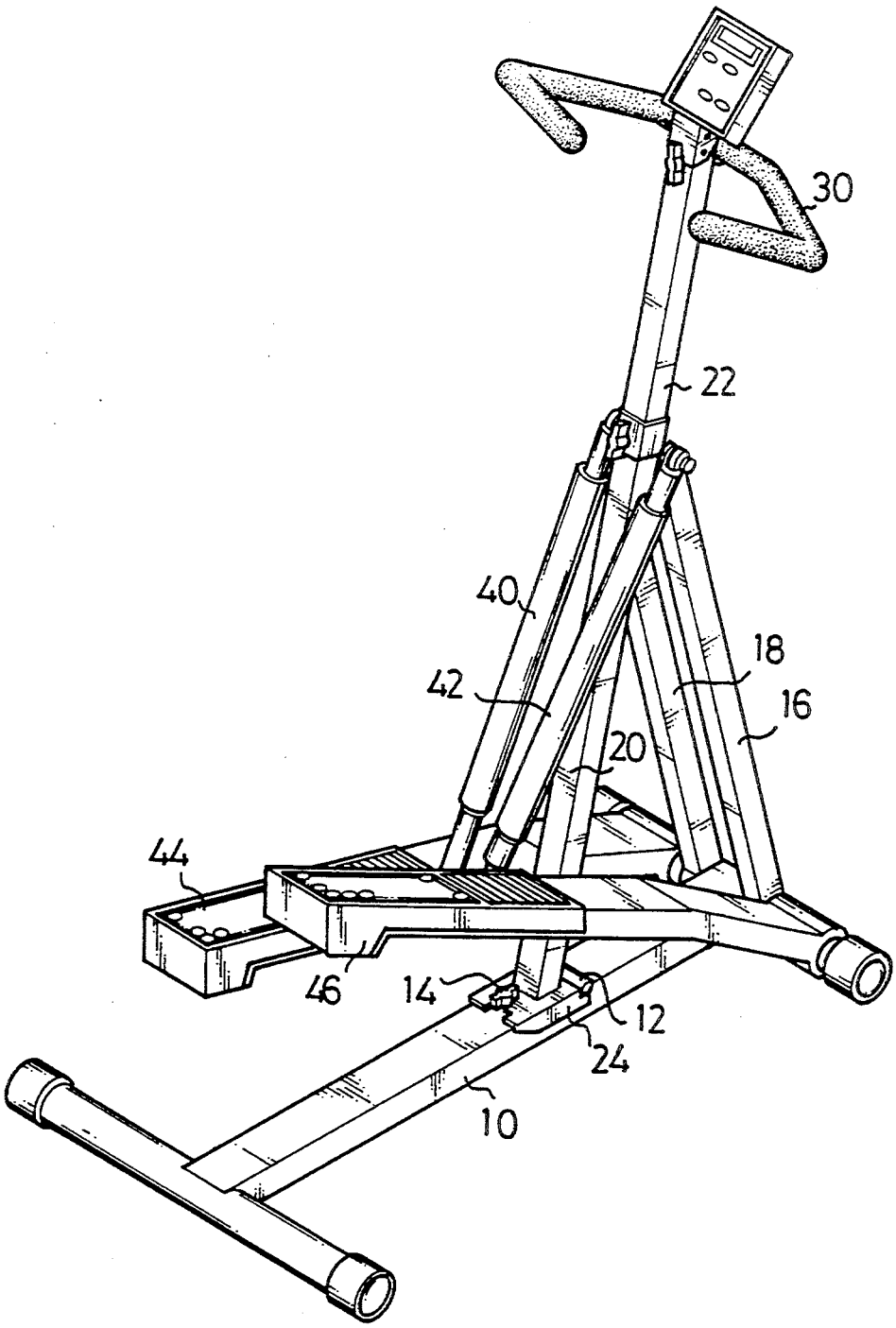
FIG. 1 is a perspective view of a stepping exerciser in accordance with the present invention.
Figure 2:
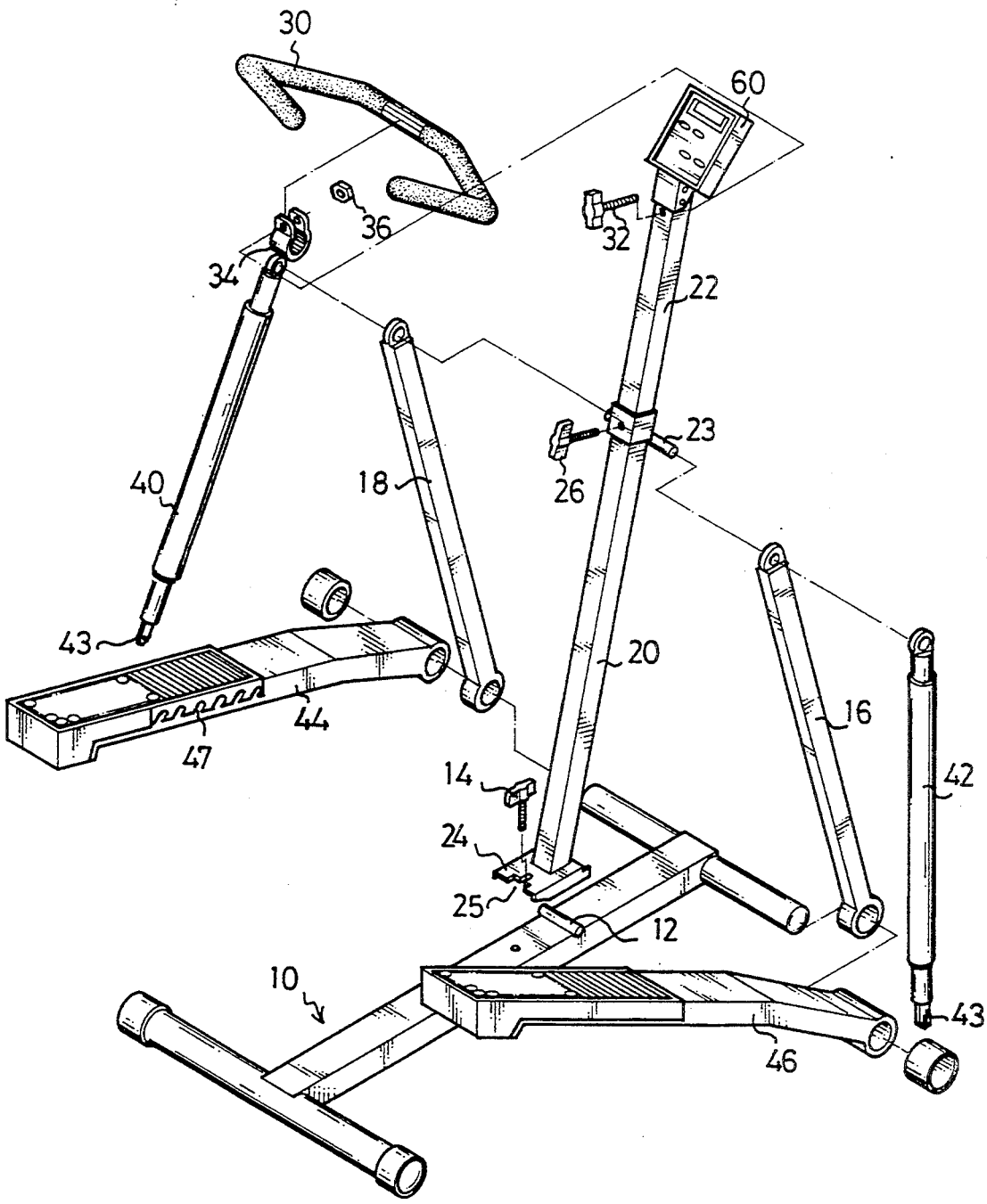
FIG. 2 is an exploded drawing of the stepping exerciser shown in FIG. 1.

Referring now to the drawings and initially to FIG. 1 and FIG. 2, a preferred embodiment of a stepping exerciser in accordance with the present invention generally includes a base 10, a post 20 being releaseably connected to the base, a pair of stepping pedals 44 and 46 being pivotally connected to the base 10, a pair of hydraulic cylinders 40 and 42 being pivotally connected to the base 10 and releasably connected to the corresponding stepping pedals 44 and 46, respectively, and a pair of support arms 16 and 18 being pivotally connected to the base 10 and the post 20.

The base 10 consists of a longitudinal member, a front cross member which is transversely linked to a front end of the longitudinal member and a rear cross member which is transversely linked to a rear end of the longitudinal member. The front and rear cross members are connected to the longitudinal member by member of welding or the like. A constraint rod 12 is fixed across an upper surface of the longitudinal member and a hole is formed at a distance behind the restraint rod 12 with a butterfly bolt 14 screwed therein.

The post 20 consists of an inner tube 22 telescopically received therein. A butterfly bolt 26 is used to secure the inner tube 22 in an extended position. A monitor 60 is mounted at the distal end of the inner tube 22. A hole is formed through the inner tube 22 at a place immediately below the monitor 60. A handle bar 30 is rotatably received within a collar 34. A butterfly bolt 32 screws through the hole on the inner tube and two holes formed at two ends of the collar 34 to engage with a nut 36 and to secure the handle bar 30 to the inner tube 22. Preferably a plurality of longitudinal grooves are formed at an inner surface of the collar 34 and a corresponding portion of the handle bar 30 to provide a more stable engagement as the collar 34 is tightened. A fixing component 24 is fixed to the lower end of the post 20. The fixing component 24 has a top plate and two side plates extending downwardly therefrom. Each of the two side plates has a longer length than the top plate at a front end so that a recess is defined to receive the restraint element 12 when the post 20 is in its upright position. A notch 25 is formed at an rear end of the top plate to cooperate with the butterfly bolt 14 to form a releasably securing member.

A pair of support arms 16 and 18 are pivotally connected to the front cross member of the base 10 and a shaft 23 fixed on the post 20 at their two ends, respectively.

A pair of hydraulic cylinders 40 and 42 are pivotally connected to the shaft 23 at their first ends, respectively. Preferably, a U-shaped buckle 43 is attached to the second end of each hydraulic cylinders 40 and 42 and thus can be releasably connected to various points of the corresponding pedals 44 and 46, respectively, in order to adjust the impedance for an individual exerciser's needs.

A pair of pedals 44 and 46 are pivotally connected to the front cross member of the base 10 at one end thereof. Preferably, a number of cutouts 47 are formed at the side surface of the pedals which face each other to cooperate with the U-shaped buckle 43 so that the hydraulic cylinders 40 and 42 can be linked to various points of the corresponding pedals 44 and 46, respectively.

Figure 3:
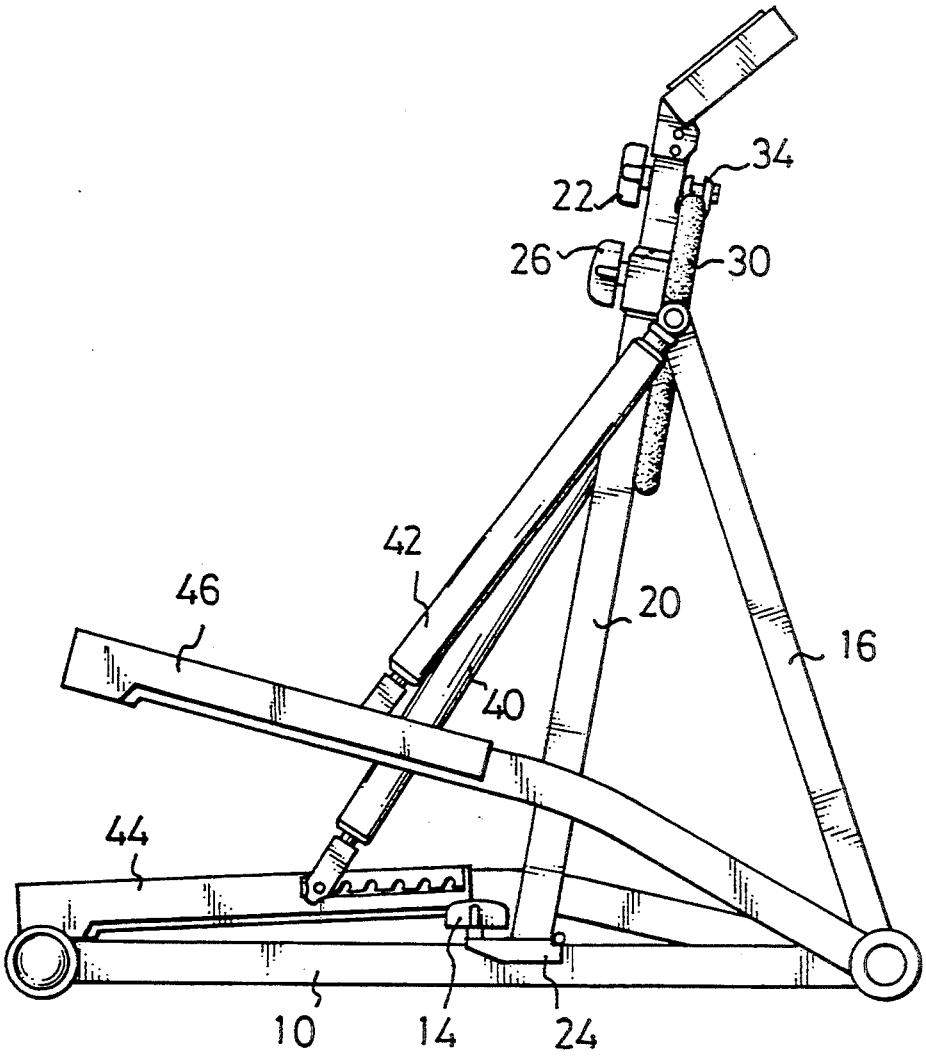
FIG. 3 is a .side elevation view showing the stepping exerciser with the handle bar being lowered and the inner tube being retracted according to the present invention.
Figure 4:
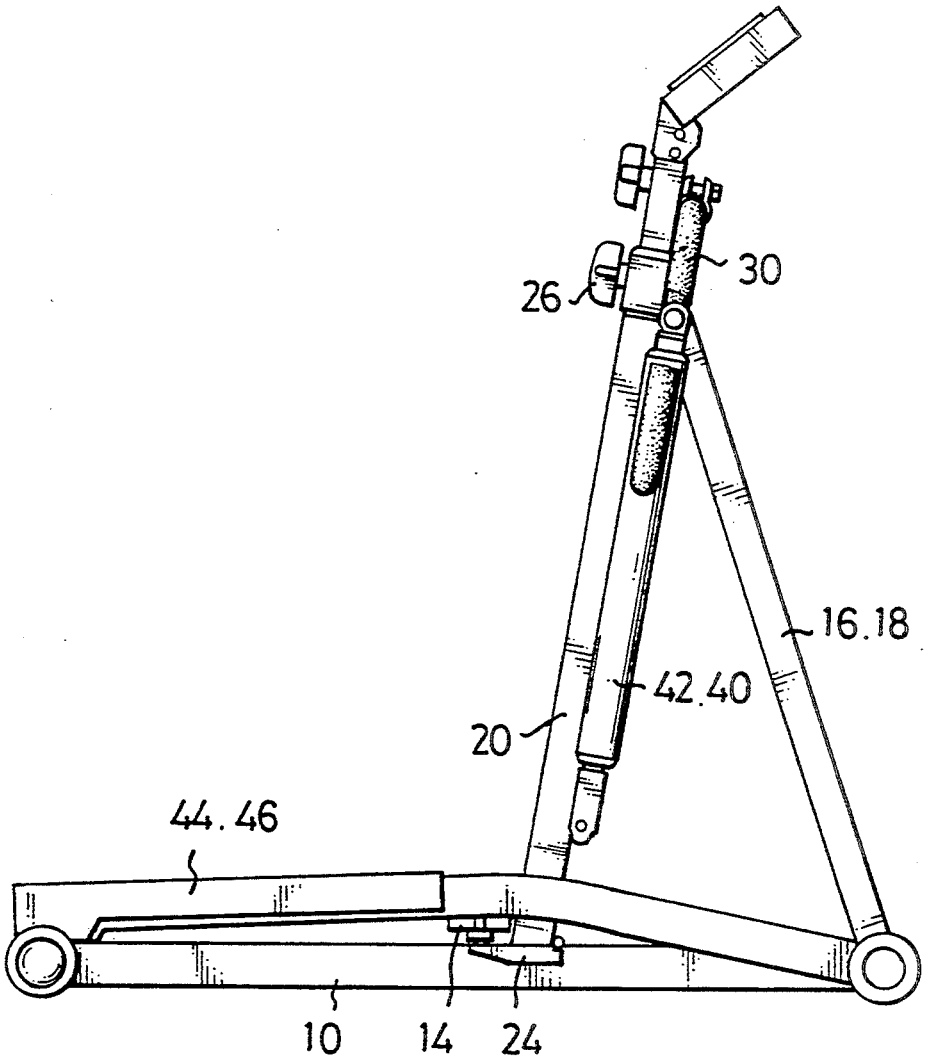
FIG. 4 is a drawing similar to FIG. 3 showing the pedals being disengaged from the corresponding hydraulic cylinders.

Referring now to FIGS. 3 to 6, which illustrate the steps of folding the stepping exerciser. FIG. 3 shows that the handle bar 30 is lowered by loosening of the collar 34 caused by the rotation of the butterfly bolt 32 and the inner tube 22 is retracted by releasing the butterfly bolt 26. FIG. 4 illustrates that the hydraulic cylinders 40 and 42 are disengaged with the corresponding pedals 44 and 46, respectively.

Figure 5:
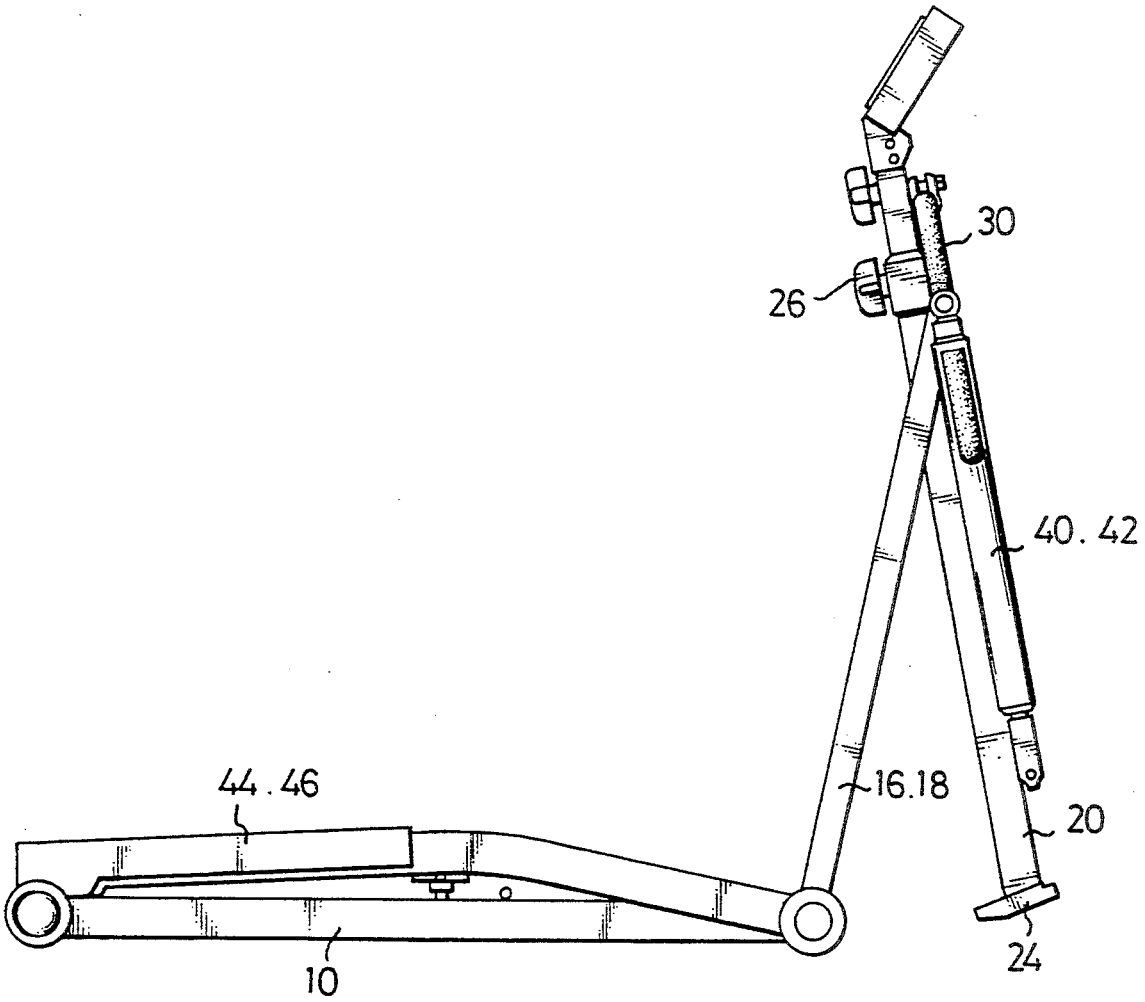
FIG. 5 is a drawing similar to FIG. 4 showing the post being released and swung away from the base.
Figure 6:
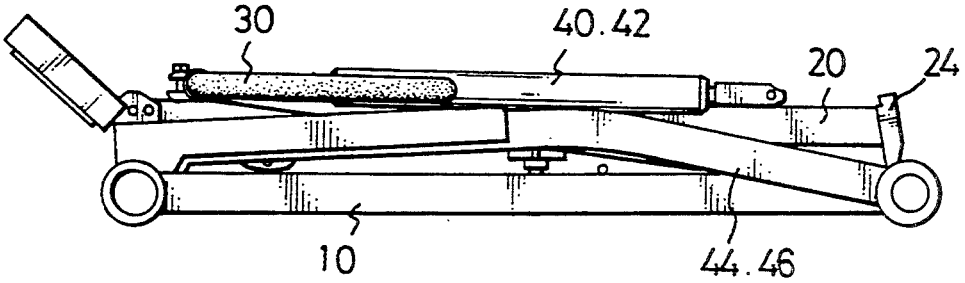
FIG. 6 illustrates a retracted and folded state of the stepping exerciser in accordance with the present invention.

FIG. 5 illustrates that the post 20 is released from the base 10 by rotating the butterfly bolt 14 and then the post 20 with the hydraulic cylinders 40, 42 and the handle bar 30 are swung backwardly and finally lies on the top of the base 10 as shown in FIG. 6.

Although the invention has been explained in relation to its preferred embodiment, it is to be understood that many other possible modifications and variations can be made without departing from the spirit and scope of the invention as hereinafter claimed.

I claim:

1. A foldable stepping exerciser comprising:

a base (10) including a first securing member (14) and a restraining element (12);

a pair of stepping pedals (44,46) being pivotally connected to an end of the base at an end thereof, respectively;

a pair of hydraulic cylinders (40,42) being releaseably connected to the corresponding stepping pedals at a first end thereof, respectively;

a handle bar (30);

a telescopic post (20) being releaseably secured to the base and a second end of the hydraulic cylinders being pivotally connected thereto having:

a fixing component (24) disposed at an end thereof to cooperate with the restraining element (12) and the first securing member (14) for retaining the telescopic post upright;

an inner tube (22) being telescopically received therein;

a second securing member (26) for retaining the inner tube in an extended position; and a third securing member (32) disposed at the distal end of the inner tube to rotatably secure the handle bar thereon; and a pair of support arms (16,18) being pivotally linked to the end of the base at a first end thereof and being pivotally linked to the post at a second end thereof to function as a swinging support and a linkage between the base and the post as the post is released from the base.

2. A foldable stepping exerciser as defined in claim 1 wherein the third securing member comprises a butterfly bolt, a nut and a collar having longitudinal grooves around the inner surface thereof.

3. A foldable stepping exerciser as defined in claim 2 wherein the handle bar has a center portion which has longitudinal grooves around the outer surface of the handle bar to engage with the inner surface of the collar.

4. A foldable stepping exerciser as defined in claim 1 wherein the fixing element has a top plate with a recess (25) defined at the rear end to cooperate with the first securing member and two lateral side plates with length longer than the top plate at the front ends to cooperate with the restraining element for constraining the post in position.

* * * * *